US009378875B2

(12) United States Patent
Kim et al.

(10) Patent No.: US 9,378,875 B2
(45) Date of Patent: Jun. 28, 2016

(54) FERROMAGNETIC NANO METAL POWDER

(71) Applicant: SAMSUNG ELECTRO-MECHANICS CO., LTD., Suwon-si, Gyeonggi-do (KR)

(72) Inventors: Jae Yeong Kim, Suwon-si (KR); Sung-Yong An, Suwon-si (KR); Hak-Kwan Kim, Suwon-si (KR); Jung-Wook Seo, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 112 days.

(21) Appl. No.: 14/228,243

(22) Filed: Mar. 27, 2014

(65) Prior Publication Data

US 2015/0115193 A1 Apr. 30, 2015

(30) Foreign Application Priority Data

Oct. 30, 2013 (KR) ..... 10-2013-0130510

(51) Int. Cl.
*H01F 1/00* (2006.01)

(52) U.S. Cl.
CPC ..... *H01F 1/0054* (2013.01)

(58) Field of Classification Search
CPC ..... H01F 1/0054
USPC ..... 428/403; 252/62.55
See application file for complete search history.

(56) References Cited

U.S. PATENT DOCUMENTS

| | | | | |
|---|---|---|---|---|
| 7,485,366 | B2 * | 2/2009 | Ma et al. | 428/403 |
| 8,294,040 | B2 * | 10/2012 | Shimizu et al. | 174/261 |
| 8,669,316 | B2 * | 3/2014 | Lee et al. | 524/431 |
| 2002/0014181 | A1 * | 2/2002 | Lashmore et al. | 106/286.3 |

* cited by examiner

*Primary Examiner* — Leszek Kiliman
(74) *Attorney, Agent, or Firm* — McDermott Will & Emery LLP

(57) ABSTRACT

The present invention related to ferromagnetic nano-metal powders and more particularly, to ferromagnetic nano-metal powders for increasing packing density by decreasing the porosity between micro-sized soft magnetic metal powders. According to an embodiment of the present invention, the ferromagnetic nano-metal powder allows high packing density and high magnetic property at a high frequency to fill the pores inevitably generated during the manufacturing process of an inductor using the soft magnetic metal powders.

10 Claims, 3 Drawing Sheets

FERROMAGNETIC NANO METAL POWDER

TECHNICAL FIELD

The present invention relates to ferromagnetic nano-metal powders and more particularly, to ferromagnetic nano-metal powders for increasing packing density by decreasing the porosity between micro-sized soft magnetic metal powders.

BACKGROUND ART

CPUs being used in portable mobile devices such as notebooks or smart phones have been developed for power savings with low-power and low-voltage models but at the same time required current and power consumption increases in response to demands for high-end features and multi-functions thereof.

A great deal of development researches has been continuously under way on DC-DC convertible inductors with smaller sizes and thinner systems while maintaining high-current and low-resistance.

Various ferrites or soft magnetic metals such as soft magnetic metal powders have been used in manufacturing miniaturized inductors to cope with high frequencies. Such materials are used independently but recently composite metal powders have been used to cope with high efficiency of inductors. The interests have been focused on improvements of uniform soft magnetic properties, low eddy current loss, low core loss at a high frequency and thermal properties.

However, since amount of soft magnetic metals used per an inductor decreases with getting smaller and thinner sizes of the inductor, the magnetic property is lowered. Thus, there is a demand to develop materials which maintain high magnetic properties at a high frequency as an operating frequency of an inductor installed in devices becomes higher.

In the inductor using soft magnetic metal powders, Fe-based soft magnetic metal powders such as Fe, Fe—Ni, Fe-based amorphous, or Fe—Ni—Cr crystalline soft magnetic metal powders are used. It is important to increase the density of materials to obtain high magnetic properties in miniaturized inductors. However, it is difficult to have sufficient packing density of metal powders due to the volume of binders or the pores inevitably generated between powders. Such a lowered packing density further causes reduction in the magnetic property, particularly in the permeability, and deteriorated performance of the inductors.

The prior art is ferromagnetic powder for dust core in KR Patent No. 2002-0037776.

SUMMARY

An object of the present invention is to provide ferromagnetic nano-metal powder for filling pores between soft magnetic metal powders.

According to an aspect of the present invention, there may be provided ferromagnetic nano-metal powders comprising ferromagnetic core particles selected from the group consisting of Fe, Co, Ni and an alloy thereof; an insulating layer coated on the surface of the ferromagnetic core particles and having a diameter of 250-500 nm.

In an embodiment, the ferromagnetic core particles may be Ni.

In an embodiment, the ferromagnetic nano-metal powder may be to fill pores of an inductor including pores.

In an embodiment, the inductor may comprise soft magnetic metal powders with a diameter of 10-50 μm.

In an embodiment, the inductor may have a porosity of 5-20%.

In an embodiment, the diameter of the pore may be 300 nm-1 μm.

In an embodiment, the soft magnetic metal powder may have a $Q_{max}$ factor of 1 MHz or less.

In an embodiment, the ferromagnetic nano-metal powder may have a Q factor (Quality factor) of 90 or higher at a frequency of 10 MHz or higher.

In an embodiment, the ferromagnetic nano-metal powder may have a $Q_{max}$ factor of 23 MHz or higher.

In an embodiment, the insulating layer may be a coating with one selected from the group consisting of aluminum oxide, silicon oxide, titanium oxide, zinc oxide and phosphate.

According to an embodiment of the present invention, there is provided ferromagnetic nano-metal powders for filling the pores inevitably caused when an inductor is manufactured using soft magnetic metal powders to exhibit high packing density and high magnetic property at a high frequency.

DETAILED DESCRIPTION

Figure 1:
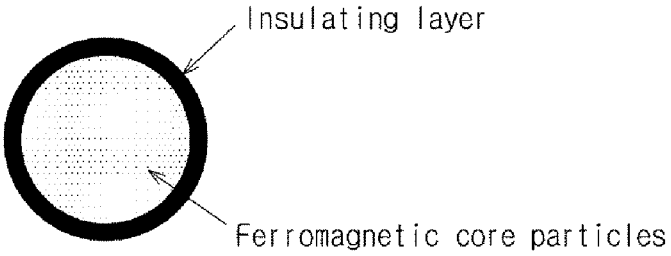
FIG. 1 illustrates a ferromagnetic nano-metal powder according to an embodiment of the present invention.
Figure 2:
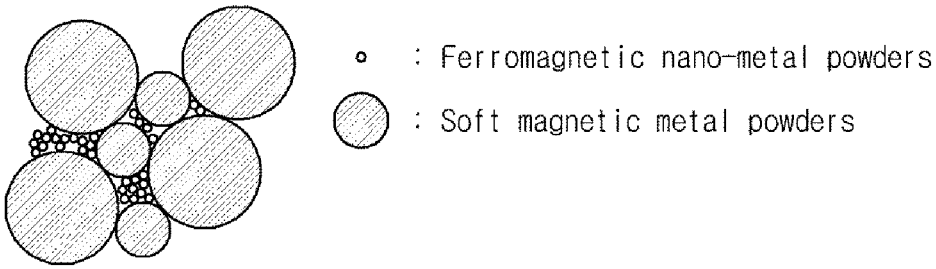
FIG. 2 illustrates the state where the pores between soft magnetic metal powders are filled with the ferromagnetic nano-metal powders according to an embodiment of the present invention.

The terms used in the description are intended to describe certain embodiments only for better understanding, and shall by no means restrict the present invention. Unless clearly used otherwise, expressions in the singular number include a plural meaning.

The term "ferromagnetism (ferromagnetic)" used in the present invention means a magnetic property of a magnetizable material in the absence of an external magnetic field. Electron spins are arranged in the same direction under the ferromagnetism and representative ferromagnetic materials are generally Fe, Co, Ni and the like.

The term "pores (porosity)" used in the present invention means gaps between magnetic metal powders which compose an inductor. The larger diameter or the evener diameter of the magnetic metal powder, the larger the pore becomes due to more gaps between the powders. The "porosity" is a fraction of the volume of pores over the total volume of the inductor composed of the magnetic metal powders as a percentage.

The term "soft magnetism (soft magnetic)" used in the present invention means that it shows small area of hysteresis loop, low coercive force and residual magnetization, and high permeability. In contrast to ferromagnetism, soft magnetic materials are magnetized only when an external magnetic field is applied so that when the external magnetic field is removed, it results in loss of the magnetization. Examples of representative soft magnetic materials include spinel-type ferrites.

The term "Q factor (Quality factor)" used in the present invention means a measure of the ratio of the energy stored in a reactive component such as inductor to the total lost energy.

Here, the higher the Q factor, the frequency-selective property, particularly the magnetic property, at a high frequency range becomes better.

The term "$Q_{max}$ factor" used in the present invention means a measure of frequency where the Q factor is the maximum. The higher $Q_{max}$ factor which is present at higher frequency regions, the magnetic property at a high frequency region can be expected.

According to an aspect of the present invention, there may be provided ferromagnetic nano-metal powders comprising ferromagnetic core particles selected from the group consisting of Fe, Co, Ni and an alloy thereof; and an insulating layer coating on the surface of the ferromagnetic core particles, and having a diameter of 250-500 nm.

In an embodiment, the ferromagnetic core particles may be selected from the group consisting of Fe, CO, Ni or an alloy thereof such as Fe—Ni, Fe—Co, Ni—Co, Fe—Ni—Co and the like, but it is not limited thereto.

The ferromagnetic core particles can be prepared through atomization, electrolysis or grinding process and the method for preparing the ferromagnetic core particles is well known in the art.

In an embodiment, the ferromagnetic core particles can be spherical or irregular shape.

In an embodiment, the diameter of the ferromagnetic nano-metal powder can be preferably 250-500 nm, more preferably 300-350 nm. When the diameter of the ferromagnetic nano-metal powder is less than 250 nm or higher than 500 nm, the magnetic property cannot be expected at the frequency range of higher than 20 MHz since the $Q_{max}$ factor falls below 20 MHz. In addition, when the diameter of the ferromagnetic nano-metal powder is less than 250 nm, the coercive force becomes larger and it can be difficult to disperse the metal powders for filling pores. On the other hand, when the diameter of the ferromagnetic nano-metal powder is larger than 500 nm, the eddy current increases and filling the pores between the soft magnetic metal powders is deteriorated. The ferromagnetic nano-metal powder having the diameter in the above defined ranges can be obtained by sieving.

In an embodiment, the ferromagnetic nano-metal powder can fill the pores of an inductor including pores. For example, in the inductor including the soft magnetic metal powders with a diameter of 10-50 μm, it is necessary to use the ferromagnetic nano-metal powders to fill the pores between the soft magnetic metal powders.

In an embodiment, the inductor can have a porosity of 5-20%. As described above, the porosity is a fraction of the volume of pores over the total volume of the inductor composed of the magnetic metal powders as a percentage. The ferromagnetic nano-metal powder can reduce the porosity of the inductor to preferably 5% or less, more preferably 3% or less, even more preferably 1.5% or less by filling the pores of the inductor.

In an embodiment, the diameter of the pores can be 300 nm-1 μm. The diameter of the pores is dependent on the diameter of the soft magnetic metal powders included in the inductor. In addition, the diameter of the pores is preferably larger than that of the ferromagnetic nano-metal powders and smaller than that of the soft magnetic metal powders.

In an embodiment, the $Q_{max}$ factor of the metal powder of the soft magnetic metal powder included in the inductor may be 1 MHz or less. Since the inductor including soft magnetic metal powders having a $Q_{max}$ factor of 1 MHz or less cannot show the magnetic property at a high frequency of 10 MHz or higher for high Q factors, the ferromagnetic nano-metal powder showing the magnetic property at a high frequency of 10 MHz or higher can be used together to improve a $Q_{max}$ factor.

In an embodiment, the Q factor of the ferromagnetic nano-metal powder can be 90 or higher at a frequency of 10 MHz or higher. Since the ferromagnetic nano-metal powders according to the present invention have a high Q factor of 90 or higher, when they are used together with the soft magnetic metal powders in manufacturing an inductor, the magnetic property can be expected at a high frequency. In an embodiment, the $Q_{max}$ factor of the ferromagnetic nano-metal powder can be 23 MHz or higher. Furthermore, the ferromagnetic nano-metal powder can have preferably constant permeability at an operating frequency of 10 MHz-100 MHz.

Figure 3:
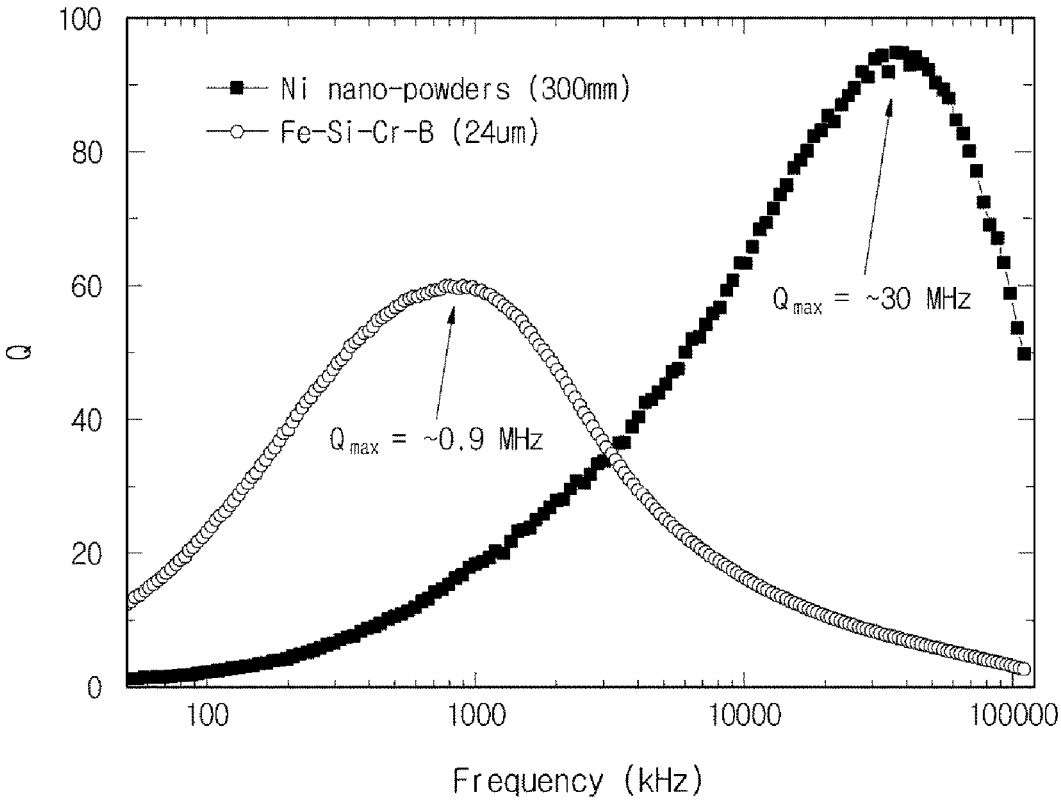
FIG. 3 is a graph illustrating Q factors of the ferromagnetic nickel metal powders according to an embodiment of the present invention and soft magnetic metal powders over frequency.

Referring to FIG. 3 illustrating Q factors for frequencies of ferromagnetic nickel metal powders according to an embodiment of the present invention and soft magnetic metal powders, Q factors and $Q_{max}$ factors for general micro-sized soft magnetic metal powders (Fe—Si—Cr—B) and ferromagnetic nano-metal powders (Ni) can be compared. For example, the Q factor of soft magnetic metal powders having a diameter of 24 μm is about 60 and shows the maximum at 0.9 MHz ($Q_{max}$), while that of ferromagnetic nickel metal powders having a diameter of 300 nm is about 95 and shows the maximum at 30 MHz ($Q_{max}$) When the $Q_{max}$ factor where the 0 factor is the maximum is present in a high frequency region, the inductor using the soft magnetic metal powders can be used at a high frequency region. Therefore, when an inductor is manufactured using soft magnetic metal powders, the $Q_{max}$ factor of the inductor can be improved by filling pores with ferromagnetic nano-metal powders of which a $Q_{max}$ factor is present relatively at a higher frequency region than that of soft magnetic metal powders. For example, when the ferromagnetic nickel metal powders having a diameter of 300 nm according to an embodiment of the present invention is used for filling pores of the inductor including soft magnetic metal powders having a diameter of 24 μm, an expected $Q_{max}$ factor is about 11 MHz.

The insulating layer can be a coating layer of an organic material, an inorganic material or a mixture of an organic material and an inorganic material. In an embodiment, when the insulating layer is a coating layer of an organic material, the insulating layer can be a coating of phenol resin or silicon resin by a thermal or photo curing. The phenol resin can be chosen from commercially available phenol, cresol, xylenol, novolak and bisphenol resin but it is not limited thereto.

In an embodiment, when the insulating layer is a coating layer of an inorganic material, the insulating layer can be a coating of one chosen from aluminum oxide, silicon oxide, titanium oxide, zinc oxide and phosphate. A method for coating metal powders using an inorganic material is well-known in the art.

For example, when the inorganic material is titanium oxide, it is appreciated that a colloidal solution in which a negatively charged amorphous titanium oxide is dispersed be used. As described above, when a colloidal solution in which an inorganic material is homogeneously dispersed is used, it allows a uniform insulating coating on the ferromagnetic core particles. Here, it is appreciated that a diameter of the inorganic material be preferably 5 to 100 nm, more preferably 5 to 50 nm, even more preferably 5 to 25 nm.

In an embodiment, when the insulating layer is a coating of a mixture of an organic and an inorganic material, it is appreciated that a mixture solution which have a viscosity of 100 to 3000 cps at 25° C. be used to form a uniform coating on the surface of the ferromagnetic core particles.

In an embodiment, it is appreciated that the insulating layer be used by 0.1-10 vol %, more preferably 0.5-5 vol % with respect to the total ferromagnetic nano-metal powders. When the insulating layer is used by less than 0.1 vol %, an insulating layer cannot be formed efficiently on the ferromagnetic core particles and the ferromagnetic core particles can be thus exposed outside which result in deteriorated insulating property, oxidation of the ferromagnetic core particles, and loss of the magnetic property. On the other hand, when the insulating layer is used by more than 10 vol %, a ratio of non-magnetic particles to the magnetic particles (ferromagnetic core particles) can be increased to cause loss of the magnetic property.

In an embodiment, soft magnetic metal powders having a diameter of 10-50 μm and ferromagnetic nano-metal powders having a diameter of 250-500 nm can be mixed and used for manufacturing an inductor. When micro-sized soft magnetic metal powders and nanometer-sized ferromagnetic nano-metal powders are used together for manufacturing an inductor, it reduces porosity and improves a packing density of an inductor compared to the case when the soft magnetic metal powders are used alone. It also increases permeability of an inductor by inhibiting eddy current and shows high Q factor at a high frequency. Furthermore, high magnetic property of an inductor can be expected at a high frequency of 10 MHz or higher by using ferromagnetic nano-metal powders having a high Q factor at a high frequency (high $Q_{max}$ factor) for manufacturing an inductor.

Hereinafter, although more detailed descriptions will be given by examples, those are only for explanation and there is no intention to limit the invention.

EXAMPLES

1. A Method for Preparing Ferromagnetic Nano-Metal Powders

A nickel salt (nickel acetylacetonate), an alkylamine (octylamine) and a surface stabilizer (tributyl phosphine) were added in an organic solvent (diphenyl ether) under an inactive atmosphere (argon atmosphere) to prevent deterioration of the permeability and magnetic flux density associated with oxidation of ferromagnetic nano-metal powders and stirred for 30 min to provide a mixture solution. The mixture solution was heat-treated at 150° C. for 30 min and at 250° C. for 1 hour to form an insulating layer in which a phosphate was used as an insulating material to form an insulating layer. The heat-treated mixture was cooled to room temperature, centrifuged and washed with ethanol. The organic solvent was removed and dried under vacuum.

A diameter of the result metal powder was observed by an electrical microscopy and 250-500 nm of a narrow particle distribution was determined. Additional milling and sieving were performed in order to obtain a desired diameter of the ferromagnetic nano-metal powder.

2. Magnetic Property of Ferromagnetic Nano-Metal Powders

Q factors and $Q_{max}$ factors of the ferromagnetic nickel nano-metal powders with a diameter of 300 nm prepared in Example 1 and the soft magnetic metal powders (Fe—Si—Cr—B) with a diameter of 24 μm were compared each other. The result is shown in FIG. 3

Referring to FIG. 3, it is noted that the soft magnetic metal powders (Fe—Si—Cr—B) with a diameter of 24 μm show a Q factor of about 60 and a $Q_{max}$ factor at 0.9 MHz, while the ferromagnetic nickel nano-metal powders with a diameter of 300 nm do a Q factor of about 95 and a $Q_{max}$ factor at 30 MHz.

Thus, it is noted that when an inductor is prepared by using the soft magnetic metal powders, there is limitation to use it at a relatively high frequency region since the $Q_{max}$ factor is only 0.9 MHz.

The following Table 1 shows $Q_{max}$ factors according to the diameter of the ferromagnetic nano-metal powders prepared in Example 1.

TABLE 1

| Diameter(nm) | $Q_{max}$ (MHz) |
|---|---|
| 150 | 14 |
| 200 | 21 |
| 225 | 22 |
| 250 | 27 |
| 300 | 30 |
| 350 | 29 |
| 400 | 28 |
| 450 | 26 |
| 500 | 25 |
| 525 | 22 |
| 550 | 16 |
| 600 | 13 |

Referring to Table 1, the $Q_{max}$ factor varies with the diameter of the ferromagnetic nano-metal powders and particularly, it shows a $Q_{max}$ factor of 25-30 MHz, when the diameter is in a range of 250-500 nm.

Q factor and $Q_{max}$ factor, after the soft magnetic metal powders (Fe—Si—Cr—B) with a diameter of 24 μm and the ferromagnetic nano-metal powders (Ni) were mixed and used for manufacturing an inductor, were determined in order to determine if the magnetic property of the inductor is improved at a high frequency. The result is shown in Table 2.

TABLE 2

| Diameter(nm) of the ferromagnetic nano-metal powder | Q factor at 10 MHz | $Q_{max}$ (MHz) |
|---|---|---|
| 150 | 66 | 2 |
| 200 | 72 | 3 |
| 225 | 77 | 6 |
| 250 | 86 | 10 |
| 300 | 93 | 11 |
| 350 | 92 | 9 |
| 400 | 88 | 9 |
| 450 | 86 | 8 |
| 500 | 85 | 8 |
| 525 | 77 | 5 |
| 550 | 76 | 3 |
| 600 | 62 | 3 |

Referring to Table 2, it is noted that when the soft magnetic metal powders (Fe—Si—Cr—B) with a diameter of 24 μm and the ferromagnetic nano-metal powders (Ni) having a different diameter are mixed, Q factor and $Q_{max}$ factor are changed with the diameter of the ferromagnetic nano-metal powders which are used to fill the pores.

When the diameter of the ferromagnetic nano-metal powders is 250-500 nm, it shows 85 or higher of the Q factor at 10 MHz and 8 MHz or higher of the $Q_{max}$ factor, which shows higher magnetic property at a high frequency region, compared to the soft magnetic metal powders (Fe—Si—Cr—B) with a diameter of 24 μm (about 60 of the Q factor and about 0.9 MHz of the $Q_{max}$ factor).

As described above, when the ferromagnetic nano-metal powders having a diameter of 250-500 nm of the present invention is used to fill the pores inevitably generated during the manufacturing process of an inductor using the soft magnetic metal powders, the packing density is improved and the formation of eddy current is prevented. Further, the permeability and the magnetic property at a high frequency of the inductor prepared thereby are also improved.

While it has been described with reference to particular embodiments, it is to be appreciated that various changes and modifications may be made by those skilled in the art without departing from the spirit and scope of the embodiment herein, as defined by the appended claims and their equivalents.

What is claimed is:

1. An inductor component, comprising:

a core part including ferromagnetic nano-metal powders and soft magnetic metal powders, wherein the ferromagnetic nano-metal powders have ferromagnetic core particles and an insulating layer coated on a surface of the ferromagnetic core particles, wherein the soft magnetic metal powders have a larger diameter than that of the ferromagnetic nano-metal powders, and wherein the ferromagnetic nano-metal powders fill regions between adjacent soft magnetic metal powders.

2. The inductor component of claim 1, wherein the ferromagnetic core particles are selected from the group consisting of Fe, Co, Ni, and an alloy thereof.

3. The inductor component of claim 1, wherein the insulating layer has a diameter of 250-500 nm.

4. The inductor component of claim 1, wherein the soft magnetic metal powders have a diameter of 10-50 μm.

5. The inductor component of claim 1, wherein the core part has a porosity less than or the same as 5%.

6. The inductor component of claim 1, wherein a diameter of a region between the adjacent soft magnetic metal powders is 300 nm-1 μm.

7. The inductor component of claim 1, wherein the soft magnetic metal powders have a Qmax factor of 1 MHz or less.

8. The inductor component of claim 1, wherein the ferromagnetic nano-metal powders have a Q factor of 90 or higher at a frequency of 10 MHz or higher.

9. The inductor component of claim 1, wherein the ferromagnetic nano-metal powders have a Qmax factor of 23 MHz or higher.

10. The inductor component of claim 1, wherein the insulating layer is a coating with one selected from the group consisting of aluminum oxide, silicon oxide, titanium oxide, zinc oxide and phosphate.

* * * * *